US007823729B2

(12) United States Patent
Lee

(10) Patent No.: US 7,823,729 B2
(45) Date of Patent: Nov. 2, 2010

(54) INFLATABLE PACKAGING BAG

(75) Inventor: Ting-Kuo Lee, Taipei (TW)

(73) Assignee: Camry Packing Industrial Limited, Sindian (TW)

( * ) Notice: Subject to any disclaimer, the term of this patent is extended or adjusted under 35 U.S.C. 154(b) by 255 days.

(21) Appl. No.: 10/817,788

(22) Filed: Apr. 6, 2004

(65) Prior Publication Data

US 2005/0103676 A1 May 19, 2005

(30) Foreign Application Priority Data

Nov. 19, 2003 (TW) ..... 92220419 U

(51) Int. Cl.
*B65D 81/02* (2006.01)
*B65D 81/03* (2006.01)

(52) U.S. Cl. ..... 206/522; 206/521; 383/3

(58) Field of Classification Search ..... 206/522, 206/591–592, 594, 521, 583; 383/3, 66, 383/37, 87; 446/220–224
See application file for complete search history.

(56) References Cited

U.S. PATENT DOCUMENTS 4,465,188 A * 8/1984 Soroka et al. ..... 206/522
5,451,179 A * 9/1995 LaRoi et al. ..... 446/224
5,469,966 A * 11/1995 Boyer ..... 206/522
5,564,143 A * 10/1996 Pekar et al. ..... 5/708
6,629,777 B2 * 10/2003 Tanaka et al. ..... 383/3
6,827,099 B2 * 12/2004 Tanaka et al. ..... 137/255
6,913,803 B2 * 7/2005 Peper ..... 428/35.2
2002/0064319 A1 * 5/2002 Tanaka et al. ..... 383/3

* cited by examiner

*Primary Examiner*—Mickey Vu
*Assistant Examiner*—Steven A. Reynolds
(74) *Attorney, Agent, or Firm*—Rabin & Berdo, P.C.

(57) ABSTRACT

An inflatable packaging bag formed of a plurality of independent air bags joined to one another by way of heat-sealing, having an air inlet through which compressed air is supplied to inflate the independent air bags. Each independent air bag is formed of a top four thin-sheet flexible layers including a top layer, a bottom layer, a top air-valve layer, and a bottom air-valve layer, having heat sealed seams that seal the layers, constituting an enclosed air chamber such that when some of the independent air bags are punctured, the other independent air bags work normally to continue to protect storage items put inside the inflatable packaging bag and surrounded by the independent air bags.

12 Claims, 4 Drawing Sheets

INFLATABLE PACKAGING BAG

BACKGROUND OF THE INVENTION

1. Field of the Invention

The present invention relates to an inflatable packaging bag and more particularly, to such an inflatable packaging bag, which comprises a plurality of independent air bags joined together by heat sealing. The independent air bags surround a storage space for receiving storage items requiring protection from impact etc. Even if some of the independent air bags are punctured, the inflatable packaging bag can still work well to protect storage items against vibration and impact.

2. Description of Related Art

Conventionally, plastic packing sheets with small air cells may be used to pack storage items in cartons and to protect storage items against vibration and impact. These plastic packing sheets are effective to absorb weak shock waves, however they cannot protect storage items against significant impact.

Taiwan patent publication no. 363600 discloses a buffer packing bag, which comprises an inner wall, an outer wall, and an air chamber defined between the inner wall and the outer wall. When the buffer packing bag is inflated, the inner wall is closely attached to the storage item, and the inflated air chamber gives protection to the storage item. Taiwan patent publication no. 128326 discloses a buffer packing material, which comprises a rectangular air bag with a check valve. According to this design, the body of the buffer packing material is folded up, forming two air bag portions, which have respective inner sides sealed to each other with a sealing line. When inflating the buffer packing material, the sealing line limits the inflation status of the corresponding side of the buffer packing material.

The aforesaid two prior art designs use the air chamber or air bag portions to protect storage items against vibration etc. However, if the air chamber or one air bag portion is penetrated or ruptured during transportation, air immediately leaks out of the buffer packing bag or buffer packing material, and the buffer packing bag or buffer packing material will soon lose the buffering and protecting feature. Further, the air valve structures of the aforesaid two prior art designs are complex and require too much labor during fabrication, thereby resulting in high manufacturing cost.

SUMMARY OF THE INVENTION

The inflatable packaging bag comprises a plurality of independent air bags joined to one another by way of heat sealing, each independent air bag having an air passage hole, and an air inlet in communication with the air passage hole of each independent air bag for input of compressed air to inflate the independent air bags. Each independent air bag is formed of four thin-sheet flexible layers including a top layer, a bottom layer, a top air-valve layer, and a bottom air-valve layer. Each independent air bag comprises two peripheral heat sealed seams longitudinally disposed at two opposite lateral sides to seal the four thin-sheet flexible layers of the respective independent air bag together, a narrow opening transversely extended between the peripheral heat sealed seams at a top side, first and second top heat sealed seams and a third top heat sealed seam connected between the peripheral heat sealed seams and extended along the opening at two sides. The first top heat sealed seam and the third top heat sealed seam seal the top layer and the bottom layer together, defining with the peripheral heat sealed seams an air chamber. The second top heat sealed seam extends along one side of the narrow opening opposite to the third top heat sealed seam and seals the top layer and the bottom layer together, defining with the first top heat sealed seam the air passage hole of the respective independent air bag. When the independent air bags are inflated, the independent air bags define a receiving space for receiving storage items requiring protection, and keep storage items well protected by the inflated independent air bags against vibration and collision. Even if some of the independent air bags are punctured, the inflatable packaging bag can still work well to effectively protect storage items against vibration and collision.

DETAILED DESCRIPTION OF THE PREFERRED EMBODIMENT

Figure 1:
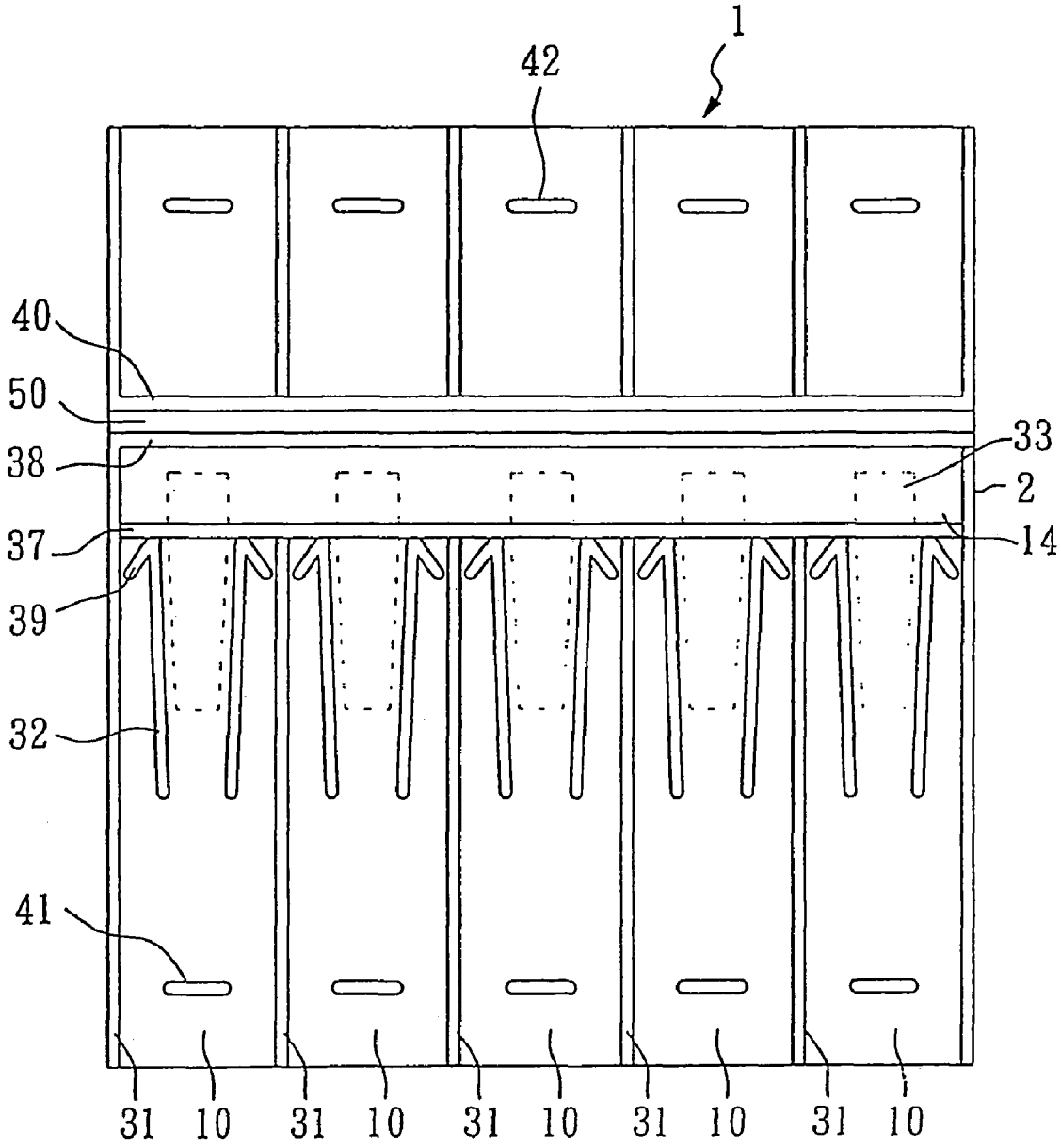
FIG. 1 is a schematic drawing showing the status of an inflatable packaging bag before inflation according to the present invention.

Referring to FIG. 1, an inflatable packaging bag 1 is shown composed of a plurality of air bags 10 joined to one another by way of heat sealing. Each air bag 10 has an air passage hole 14 in a neck. The air passage holes 14 of the air bags 10 are connected to an air inlet 2 through which air can be forced into the air bags 10 through the air passage holes 14.

Figure 2:
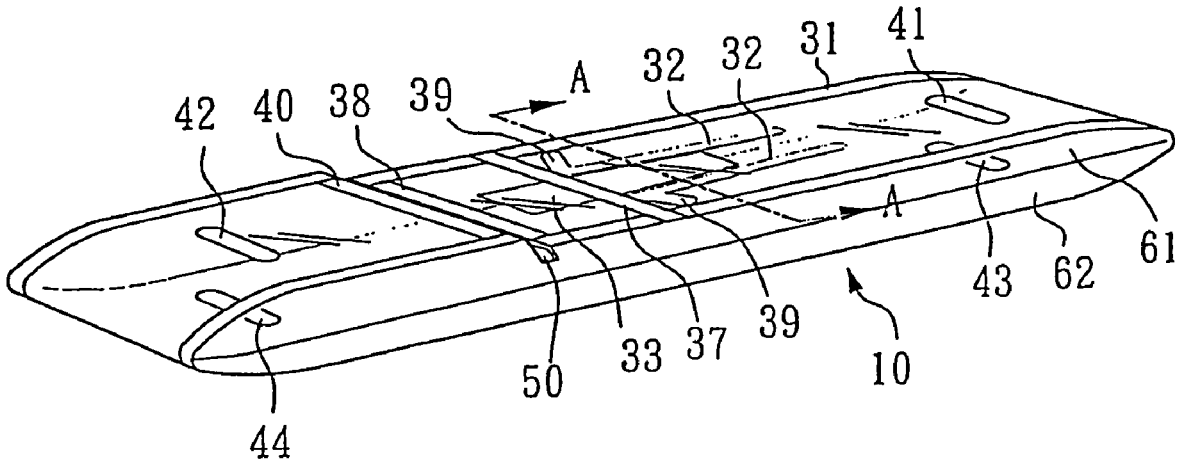
FIG. 2 is a perspective view of one independent air bag of the inflatable packaging bag according to the present invention.
Figure 3:
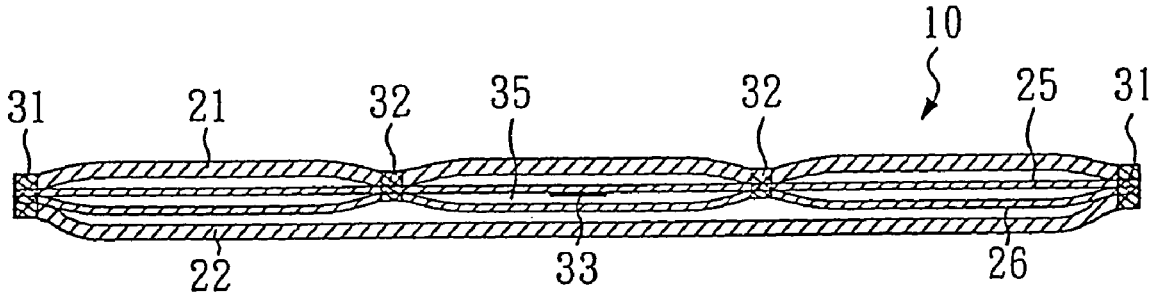
FIG. 3 is a sectional view taken along line A-A of FIG. 2.

FIG. 2 is a perspective view of one individual air bag 10. FIG. 3 is a sectional view taken along line A-A of FIG. 2. As illustrated, the air bag 10 is a four-layer thin-film structure comprising a top layer 21, a bottom layer 22, a top air-valve layer 25 and a bottom air-valve layer 26. These four layers are made from thin sheet material, for example, plastic sheet material. The air bag 10 has two peripheral heat sealed seams 31 longitudinally disposed at two opposite lateral sides to seal the four layers 21, 22, 25, 26 together, a narrow opening 50 transversely extended between the heat sealed seams 31 at the top side, first and second top heat sealed seams 37, 38 and a third top heat sealed seam 40 connected between the peripheral heat sealed seams 31 and extended along the opening 50 at two sides, wherein the first top heat sealed seam 37 and the third top heat sealed seam 40 seal the top layer 21 and the bottom layer 22 together and define with the peripheral heat sealed seams 31 an air chamber; the second top heat sealed seam 38 extends along one side of the narrow opening 50 opposite to the third top heat sealed seam 40 and seals the top layer 21 and the bottom layer 22 together and defines with the first top heat sealed seam 37 one air passage hole 14. The air passage hole 14 of the air bag 10 is disposed in communication with the air passage holes 14 of the other air bags 10 and connected to the air inlet 2 of the inflatable packaging bag 1 (see FIG. 1).

The air bag 10 further has two fourth top heat sealed seams 32 that are spaced between the peripheral heat sealed seams 31 to seal the top layer 21, the top air-valve layer 25 and the bottom air-valve layer 26 together, defining an air input port 35. In order to prevent complete bonding between the top air-valve layer 25 and the bottom air-valve layer 26, a skin of heat resisting substance 33 is provided between the top air-valve layer 25 and the bottom air-valve layer 26 such that the air input port 35 is kept open after the formation of the fourth top heat sealed seams 32. Two oblique reinforcing heat sealed seams 39 are formed and extended across the connection between the first top heat sealed seam 37 and the fourth top heat sealed seams 32 to seal the top layer 21 and the bottom layer 22 together, preventing leakage of air out of the air bag 10.

Referring to FIGS. 1~3 again, the air bag 10 further has a first top folding line 41 and a second top folding line 42 formed in the upper part 61 of the top layer 21 and bottom layer 22 of the air bag 10 and transversely extended near two distal ends, and a first bottom folding line 43 and a second bottom folding line 44 formed in the bottom part 62 of the top layer 21 and bottom layer 22 of the air bag 10 corresponding to the first top folding line 41 and the second top folding line 42 respectively. As indicated above, the second top heat sealed seam 38 and the third top heat sealed seam 40 define the opening 50 through which an object under protection is put into the inside of the inflatable packaging bag 1.

Figure 4:
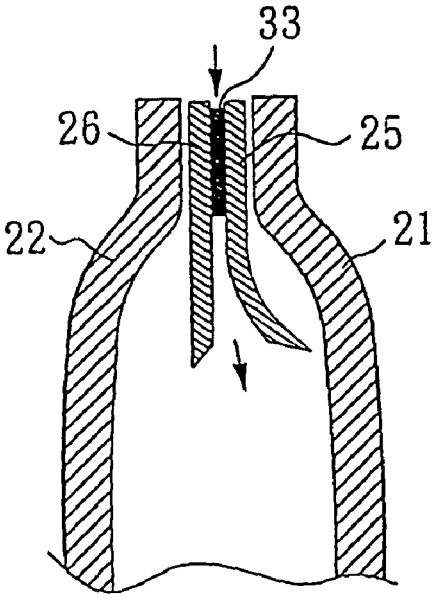
FIG. 4 is a sectional view of a part of the present invention, showing compressed air driven into the inflatable packaging bag.
Figure 7:
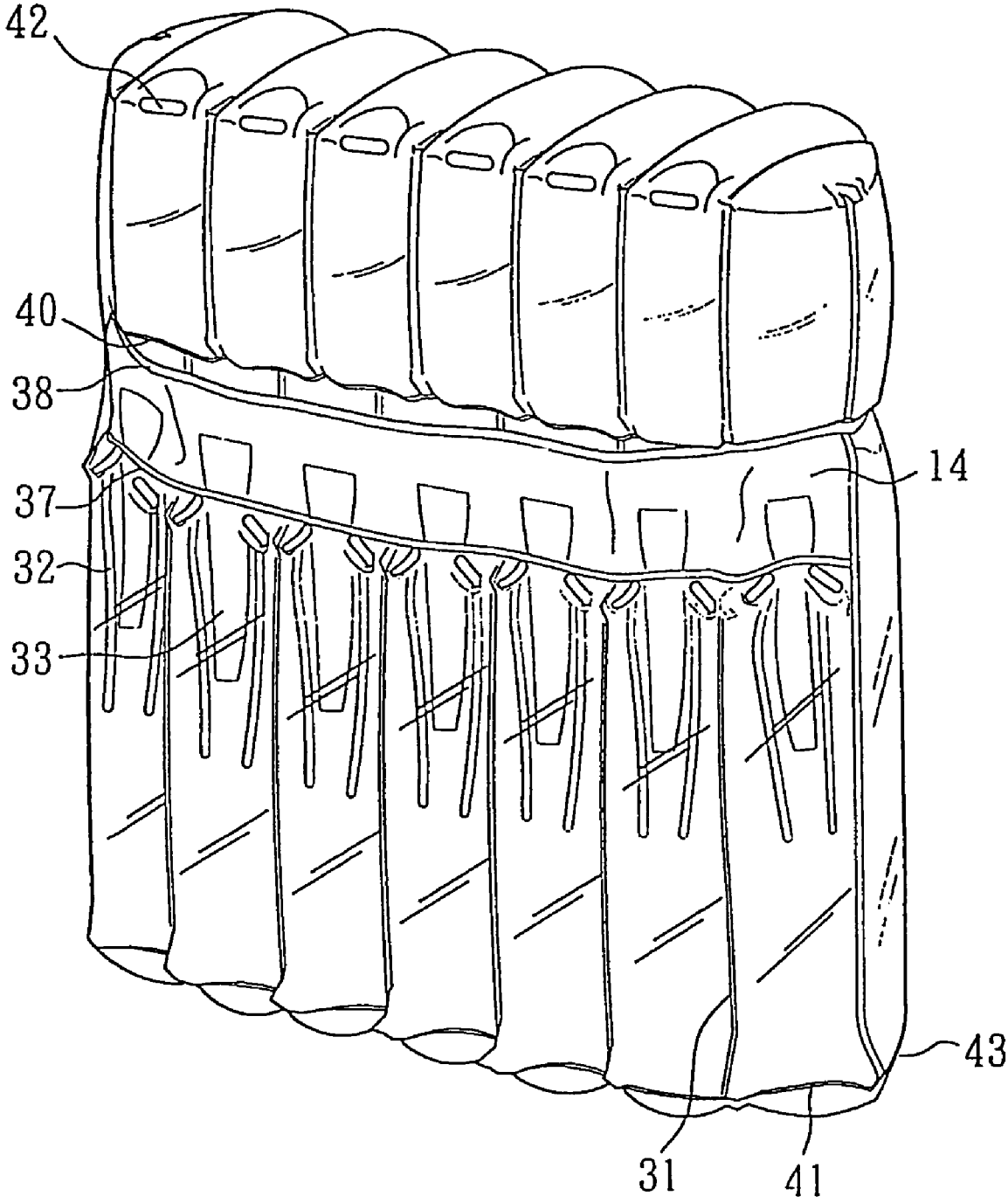
FIG. 7 is a perspective view of the present invention, showing the air bags of the inflatable packaging bag inflated.

Referring to FIG. 4, when pumping air into the air inlet of the inflatable packaging bag 1, compressed air will pass through the air input port into the air bags 10 via the air passage holes of the air bags 10. Referring to FIG. 7, when air has been pumped into every air bag 10 of the inflatable packaging bag 1, the air bags 10 are inflated, defining a receiving space for holding storage items, keeping storage items protected by the inflated air bags 10 against collision. Because the air bags 10 define a respective individual air chamber sealed by the respective heat sealed seams 31, 37, 39, 40, the inflatable packaging bag 1 can still function well even if some of the air bags 10 are punctured.

Figure 5:
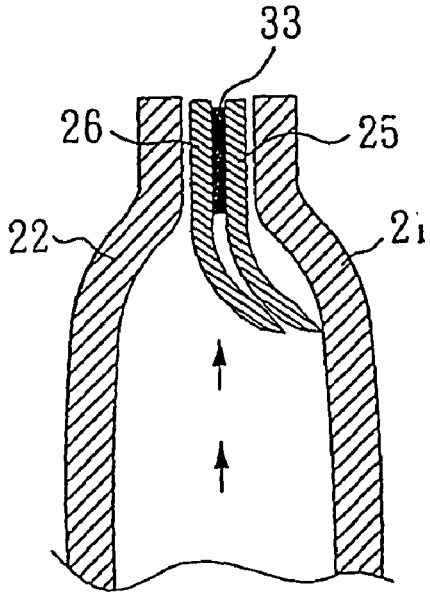
FIG. 5 is a sectional view showing the top and bottom valve layers biased and the air passage hole closed.
Figure 6:
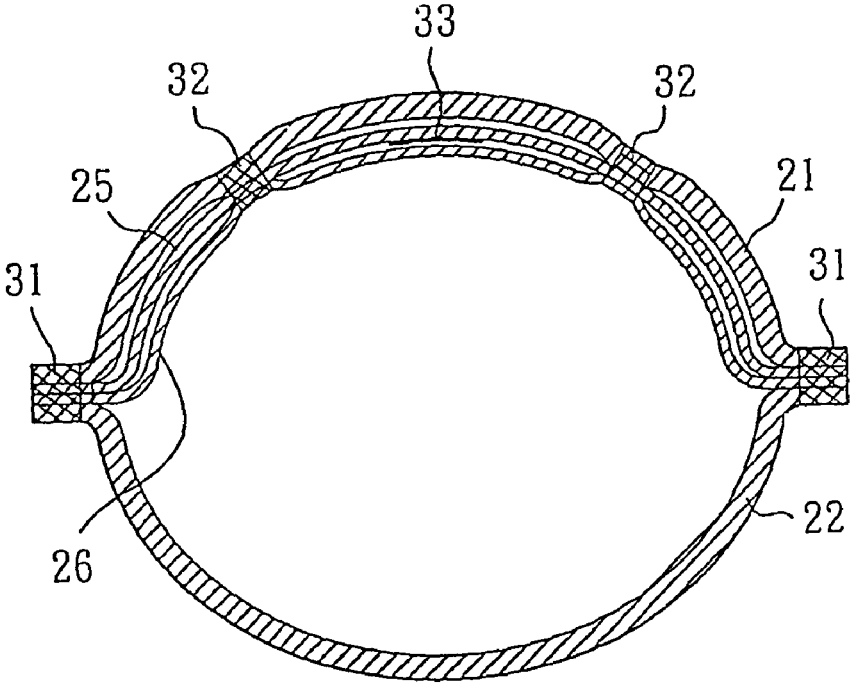
FIG. 6 is a cross sectional view of the inflatable packaging bag corresponding to the status shown in FIG. 5.

Referring to FIGS. 5 and 6, after the air bag 10 has been pumped to a maximum inflated status, the high pressure inside air forces the free side of the top air-valve layer 25 and the bottom air-valve layer 26 toward the side of the top layer 21, thereby closing the air input port 35, and therefore inside air is prevented from escaping out of the air bag 10. After inflation of all the air bags 10 of the inflatable packaging bag 1, the space surrounded by the inflated air bags 10 is provided for storage items, and storage items can be well protected by the inflated air bags 10 against vibration or collision during transportation. Because the air passage holes 14 of the air bags 10 are not inflated at this time, they are in a thin-sheet manner that can be used to close the narrow openings 50 of the air bags 10 after insertion of storage items into the space surrounded by the air bags 10.

As stated before, the air passage hole 14 is formed in the neck of the respective air bag 10. Alternatively, the air passage hole 14 can be formed in the top side of the air bag 10 like the cover flap of an envelope, or any suitable location at the air bag 10.

A prototype of the inflatable packaging bag has been constructed with the features of FIGS. 1~7. The inflatable packaging bag functions smoothly to provide all of the features discussed earlier.

The air bags 10 may be inflated with air or an inert gas whereby the latter can provide some protection against fire.

Although the present invention has been explained in relation to its preferred embodiment, it is to be understood that many other possible modifications and variations can be made without departing from the spirit and scope of the invention as hereinafter claimed.

What is claimed is:

1. An inflatable packaging bag comprising a plurality of independent air bags separated one from another by way of heat sealing, said independent air bags being formed of a plurality of thin-sheet flexible layers, at least two edges of the flexible layers being laterally coterminous, the flexible layers including a top layer, a bottom layer, a top air-valve layer, and a bottom air-valve layer, each of said independent air bags having an air passage hole, an air inlet in communication with the air passage hole of each said independent air bag for input of compressed air to inflate said independent air bags, an air input port disposed away from the bottom layer and formed by two fourth top heat sealed seams spaced between two peripheral heat sealed seams to seal said top layer, said top air-valve layer and said bottom air-valve layer together, said bottom layer being disconnected from said two fourth top heat sealed seams, said peripheral heat sealed seams longitudinally disposed at two opposite lateral sides to seal the thin-sheet flexible layers of the respective independent air bag together, a narrow opening transversely extended between said peripheral heat sealed seams at a top side, first and second top heat sealed seams and a third top heat sealed seam connected between said peripheral heat sealed seams and extended along said opening at two sides, said first top heat sealed seam and said third top heat sealed seam sealing said top layer and said bottom layer together and defining with said peripheral heat sealed seams an air chamber, said second top heat sealed seam extending along one side of said narrow opening opposite to said third top heat sealed seam and sealing said top layer and said bottom layer together and defining with said first top heat sealed seam the air passage hole of the respective independent air bag, and storage items for protection from impact can be contained in the packing bag, wherein each said independent air bag further comprises a skin of heat resisting substance provided between said top air-valve layer and said bottom air-valve layer to prevent complete bonding between said top air-valve layer and said bottom air-valve layer, and wherein after inflation of said independent air bags, internal high pressure of each said independent air bag forces said top air-valve layer and said bottom air-valve layer toward said top layer to close the air input port of each said independent air bag.

2. The inflatable packaging bag as claimed in claim 1, wherein the air passage holes of said independent air bags are disposed in communication with one another and connected to said air inlet.

3. The inflatable packaging bag as claimed in claim 1, wherein each said independent air bag further comprises a first top folding line and a second top folding line formed in an upper part thereof formed and transversely extended near two distal ends, and a first bottom folding line and a second bottom folding line formed in a bottom pad thereof corresponding to said first top folding line and said second top folding line respectively.

4. The inflatable packaging bag as claimed in claim 1, wherein the plurality of joined independent air bags defines a storage space for holding storage items under protection when inflated by compressed air applied into said air inlet.

5. The inflatable packaging bag as claimed in claim 1, wherein when at least one said independent air bags is punctured, the remaining independent air bags are maintained in an airtight status to protect a storage item.

6. The inflatable packaging bag as claimed in claim 1, wherein the air passage hole of each said independent air bag is used to close the opening of the respective independent air bag after inflation of said independent air bags.

7. The inflatable packaging bag as claimed in claim 1, wherein the air passage hole of each said independent air bag is formed in a neck of the respective independent air bag.

8. The inflatable packaging bag as claimed in claim 1, wherein the air passage hole of each said independent air bag is formed in a top side of the respective independent air bag.

9. The inflatable packaging bag as claimed in claim 1, wherein the four thin-sheet flexible layers of each said independent air bag are made from plastics.

10. The inflatable packaging bag as claimed in claim 1, wherein said independent air bags are inflated with an inert gas.

11. An inflatable packaging bag, comprising:

a top layer;

a top air-valve layer disposed below the top layer;

a bottom air-valve layer disposed below the top air-valve layer;

a bottom layer disposed below the bottom air-valve layer;

a plurality of first heat sealed seams connecting the top layer, the top air-valve layer, the bottom air-valve layer, and the bottom layer to form a plurality of independent air bags; and an air input port formed by two second heat sealed seams connecting said top layer, said top air-valve layer and said bottom air-valve layer, said bottom layer being disconnected from said two second heat sealed seams.

12. The inflatable packaging bag as claimed in claim 11, wherein after inflation of said independent air bags, internal high pressure of each said independent air bag forces said top air-valve layer and said bottom air-valve layer toward said top layer to close the air input port of each said independent air bag.

* * * * *